United States Patent [19]

Palacino et al.

[11] 4,337,713

[45] Jul. 6, 1982

[54] INVISIBLE STITCH HEMMING FOR TUBULAR MATERIAL

[76] Inventors: Giovanni Palacino, Via Dei Giacinti 12, Milan; Gianfranco Garzulano, Via F. Cavallotti 13, Novara; Adelmo Garagiola, Via Cavour 41, Inveruno, Milan, all of Italy

[21] Appl. No.: 175,613

[22] Filed: Aug. 6, 1980

[30] Foreign Application Priority Data

Sep. 25, 1979 [IT] Italy ..... 25966 A/79

[51] Int. Cl.[3] ..... D05B 35/04; D05B 35/10

[52] U.S. Cl. ..... 112/153; 112/272

[58] Field of Search ..... 112/153, 143, 141, 63, 112/121.11, 121.12, 306, 272

[56] References Cited

U.S. PATENT DOCUMENTS 3,970,017 7/1976 Babson et al. ..... 112/153 X 4,098,204 7/1978 Kojima ..... 112/153 X

*Primary Examiner*—Peter P. Nerbun

[57] ABSTRACT

An invisible stitch hemming device for sewing tubular workpieces having first and second vertical walls interconnected and angularly disposed one to the other. A feeler element disposed in close proximity with the walls detects areas of the workpiece having increased thickness and is operatively connected to an actuating means which is effective when such areas are detected in displacing the first wall to permit unrestricted advance of the workpiece and simultaneously the second wall moves to a position for maintaining the workpiece in alignment with the sewing axis.

6 Claims, 4 Drawing Figures

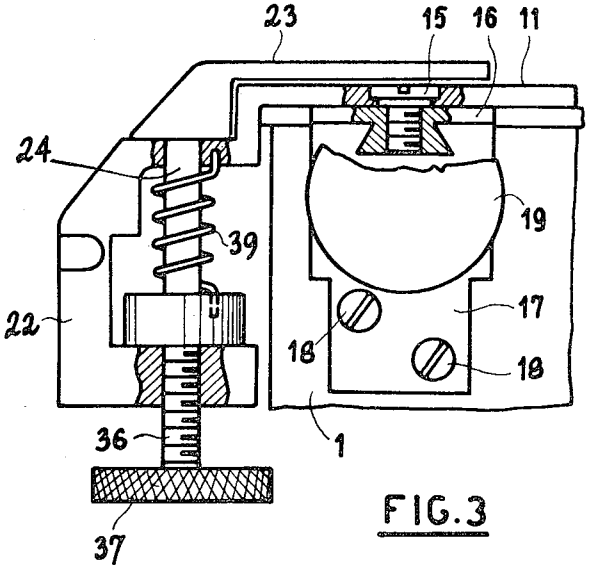
FIG. 3
FIG. 4
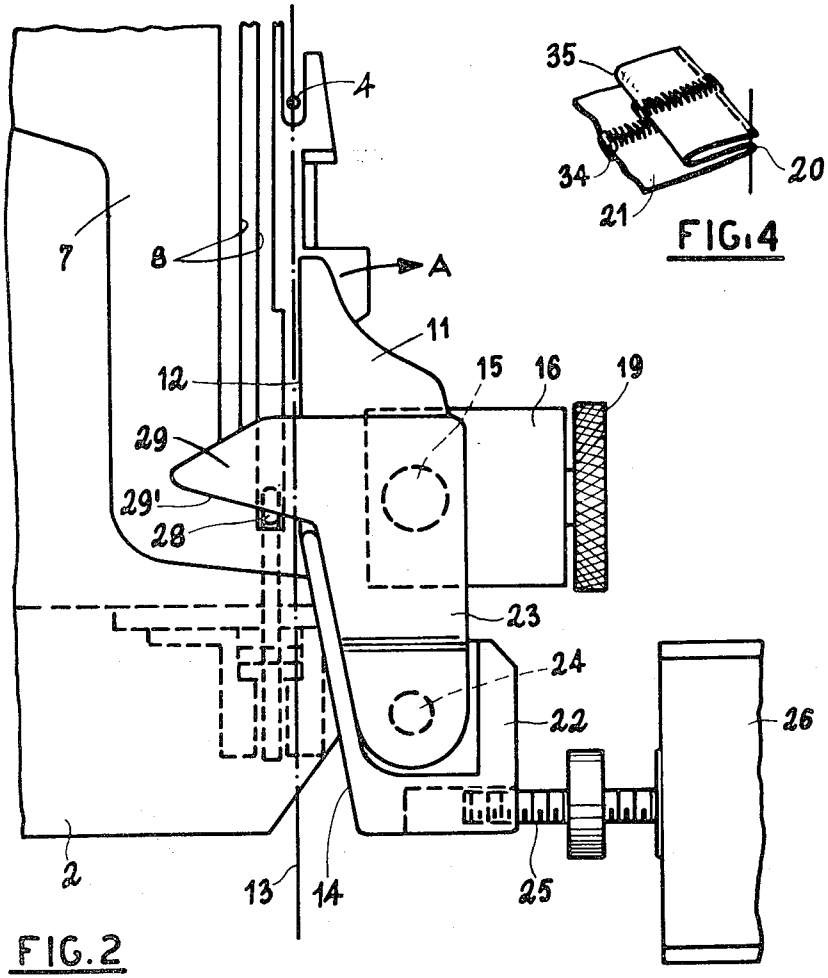
FIG. 2

INVISIBLE STITCH HEMMING FOR TUBULAR MATERIAL

BACKGROUND OF THE INVENTION

When sewing hems with invisible stitches on sewing machines of the whipstitch type, a workpiece guiding device is commonly used which includes a hemming element that is adapted to fold the marginal portion of the workpiece in the required manner, and a straight guide aligned with the sewing axis which is effective in guiding said workpiece parallel to said sewing axis. The hemming element is usually made so that it will move upwardly away from the hem being formed on tubular material just prior to completion of seaming when the initial portion of the seam again approaches the needle. This feature serves to assist the operator in preventing the sewn portion of the workpiece from again entering the sewing zone.

Additionally, to compensate for changes in sewing conditions and to facilitate adjustment of the device to accommodate such changes, known devices usually include a means for effecting movement of the straight guide in a direction which places it at a greater distance from the sewing axis. During the actual sewing operation the thickness of the workpiece material is frequently subjected to areas of increased thickness which can be attributed to such previous operations such as cross-sewing. For this reason during normal operation of the machine, the elements comprising the guiding device are maintained in a pre-selected position so that the needle of the machine is caused to pass through the thickness of the margin of the folded material in order that the thread associated with the needle is not visible within the fold when the sewn material is spread out. When these portions of the workpiece of increased thickness arrive at the guiding device, certain components thereof are caused to assume a slightly different position so as to accommodate these portions of said workpiece and avoid a binding condition as it passes between the tip of the hemming element and the hem guiding member. By avoiding such a binding condition a stretching of the material is prevented which is responsible for a slight shifting of the workpiece to the left of the sewing axis which is sufficient to prevent the needle from cooperating with that portion of the fold of the workpiece so as to satisfactorily perform its intended function. In the known forms of guiding devices the means for displacing those components for accommodating the portions of a workpiece of increased thickness is accomplished either manually by such means as a pressure plate or automatically by the actuation of electromagnetic or pneumatic control means. Actuation of the control means is accomplished automatically by a movable feeler element which engages the material and which is located in a narrow passage provided between the tip of the hemming element and the straight guide. At the moment when the increased thickness of material engages the tip of the hemming element, the movable feeler is urged in the direction of the straight guide, against the biasing force of a spring, and arrives at a position to effect actuation of the control means. The control means causes movement of said straight guide in a position where it is temporarily held for a sufficient length of time to permit those portions of the workpiece of increased thickness to reach and pass beyond the needle while maintaining alignment of and the required type of stitching in said workpiece. Although the spring operatively associated with the movable feeler element is of the light and sensitive type, it still causes a certain amount of resistance to those increased thickness portions of the workpiece as they are caused to advance through the guide and create a greater stretched condition to said workpiece than that which is considered an acceptable amount.

Although the use of the hemming element is essential to effect movement of the movable feeler element and hence the actuation of the control means, this element is not essential in forming the hem in the manner described above, for the operator of the machine manually controls the quantity of marginal material for forming said hem and is the actual creator thereof. Additionally the hemming element presents an undesirable requirement in the sewing cycle, for near the completion of said cycle, said hemming element must be manually displaced so as to prevent the initial portion of the sewn hem from making contact therewith. The procedure of displacing the hemming element necessitates what is considered excessive non-productive time for the operator must stop the sewing in progress and then with one hand displace said hemming element as required.

An object of the present invention is to eliminate the above disadvantages by providing a device in which the hemming element is replaced by an element adapted to press the first fold only of the marginal portion of the material on the needle plate and which is disposed so as not to interfere with the passage of the initial portion of the hem already sewn, i.e. such as not to require the direct intervention of the operator.

A further object is that of providing the device with a movable feeler element that is extremely sensitive to the presence of increased thicknesses of the workpieces so as to perform its intended function without causing damage to the material to be sewn.

The invention defines an invisible stitch hemming device especially adapted for hemming tubular materials which is characterized by the hemming element that defines a substantially horizontal plate having a tip portion that is insertable within the open upper fold of the hem and which is movable out of the upper fold under the thrust of the sewing as the initial sewn portion again approaches the needle.

Another desirable feature of the invention is that the feeler is disposed so as to project upwardly through the needle plate at a location beneath the tip of the hemming element.

These and other objects of the invention will become more fully apparent by reference to the appended claims and as the following detailed description proceeds in reference to the figures of drawing wherein:

BRIEF DESCRIPTION OF THE DRAWINGS

FIG. 2 is a top view of the device according to the invention shown in FIG. 1;

FIG. 3 is a view in side elevation and partially in section of a portion of the device shown in FIGS. 1 and 2; and FIG. 4 is a view of a portion of a workpiece showing the manner of folding to produce a hem and an area of increased thickness defined by cross stitching.

DESCRIPTION OF THE PREFERRED EMBODIMENT

Figure 1:
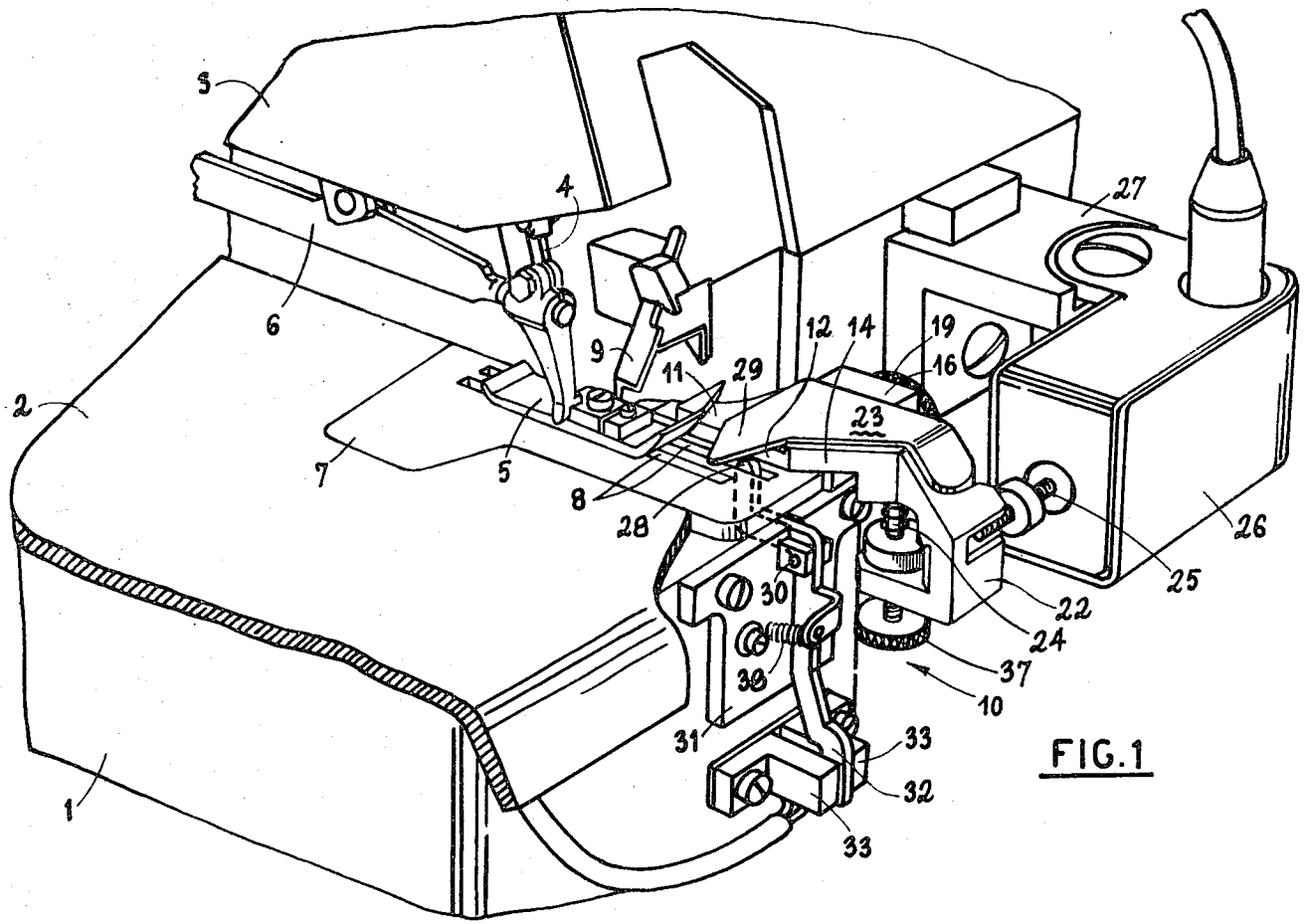
FIG. 1 is a perspective view of a portion of a sewing machine showing the device according to the invention applied thereto.

Referring now to FIG. 1, the sewing machine to which the invention is applicable includes among its many parts a base 1 on which a worksurface 2 is fixed and a column 3 which overhangs said worksurface and supports the upper well known stitching instrumentalities that include a needle 4 and a presser foot 5 mounted in a known manner to a lever 6 of the machine's presser mechanism not shown. The machine also includes a conventional needle plate 7 having the usual longitudinal openings 8 through which the feed dog (not shown) periodically projects to cooperate with the presser foot 5 and effect advance of a workpiece in a manner well known to those conversant in the sewing art.

To trim the edge of the workpiece material the machine is provided with a trimming knife 9 which is caused to function with a reciprocating movement. Forwardly of the worksurface 2 the sewing machine is provided with an invisible stitch hemming device generally indicated by numeral 10 which includes a straight guide 11 (FIG. 2) having a first vertical wall 12 extending parallel to the openings 8 of the needle plate and parallel to the sewing axis 13 that passes through the pathway of the needle 4. The straight guide 11 also includes a second vertical wall 14 connected to and extending at an oblique angle from the first wall 12. The straight guide is pivotably mounted on a bolt 15 that is assembled in a guide 16 that is adjustably mounted on a support 17 which is fixed by screws 18 to the base 1 (FIG. 3). The straight guide is adjusted by means of a knob 19 which is effective in increasing or decreasing the distance between the vertical wall 12 of the straight guide 11 and the sewing axis 13 as is necessary to be certain that the needle only goes through the thickness of a first fold 20 (FIG. 4) of the workpiece 21. The forward end of the straight guide 11 defines a block element 22 on which a substantially horizontal hemmer plate 23 is pivotably attached by means of a vertically extending pin 24. This block element 22 is operatively engaged by one end of a rod 25 whose opposite end is connected to actuator means that according to the preferred embodiment defines an electromagnet 26. This electromagnet 26 is pivotably supported by a bracket member 27 that is fixedly attached to the base of the machine. The hemming device further includes a vertically extending feeler 28, which projects from the worksurface 2 into an area located beneath a tip 29 of the hemmer plate 23 and adjacent an edge formed by the junction of the two vertical walls 12 and 14 which define a passage for advance of a workpiece along the sewing axis. This feeler 28 is pivotably supported as at 30 on a plate 31 that is fixedly attached to the base 1 (FIG. 1) forwardly of the worksurface 2. The feeler 28 extends downwardly from its support and defines a tail piece 32 which is disposed in operative association with a detector element 33 of the proximity sensor or optoelectronic type. This detector element 33 serves to activate the electromagnet 26 so as to vary the position of the vertical wall 12 upon sensing an area of increased thickness in the workpiece and which is depicted by numeral 34 in FIG. 4. More particularly the feeler 28 is located in a position whereat it will be engaged by that portion of the workpiece of increased thickness when the two folds 20 and 35 which will form a part of the hem pass between the worksurface 2 and the tip of the hemmer plate 23.

For controlling the distance between the tip 29 from the feeler 28 the lower portion of the pin 24 is extended and defines a threaded rod 36 having a knob 37 fixed on its lowermost end and by rotating said knob in one direction or the other, the hemmer plate 23 and its tip 29 can be raised or lowered as desired.

To summarize the operation and just prior to the start of the sewing cycle, the hem as shown in FIG. 4 is so disposed that the first fold 20, or lower fold is preformed and inserted between the tip 29 and the worksurface 2 and the second fold 35, or upper fold is superposed on the hemmer plate 23 so that said tip 29 serves as an inner aligning guide for said second fold.

During the actual sewing cycle, the lower fold 20 is in contact with the vertical wall 12 and in alignment with the needle 4 while it is being advanced and the edge portion of the upper fold 35 is disposed so as to be trimmed by the knife 9. When those portions of the workpiece of increased thickness engage the feeler 28, the latter is pushed downwardly causing an outwardly movement of the tail-piece 32 which effects actuation of the detector element 33 and in turn by means of suitable connections (not shown), activates the electromagnet 26.

Actuation of the electromagnet 26 causes rod 25 to pivot the block element 22 in a clockwise direction (FIG. 2) which is effective in displacing the vertical wall 12 in the direction of the indicating arrow A which permits continued advance of that portion of the workpiece of increased thickness along its initial and intended path of travel. This is made possible for while the vertical wall 12 is being displaced, the vertical wall 14 is pivoted toward the sewing axis 13 where it becomes aligned with said vertical walls 12 initial position. Although the feeler 28 returns to its original position after passage of the increased thickness portion of the workpiece, the vertical wall 12 remains in its displaced position until said increased thickness portion has advanced beyond the needle 4, thus causing invisible stitch sewing to be formed in the required way and without misalignment with respect to the fold.

Referring once again to FIG. 1, the tail-piece 32 of the feeler 28 has a coil spring 38 operatively connected therewith which serves to prevent accidental movement of the feeler as a result of vibrational forces while the machine is operating. At the completion of the sewing operation on a tubular workpiece, the initial portion of the sewing again approaches the needle and before passing the hemming device it contacts the forward edge 29′ of the tip 29, and exerts a force which causes the hemmer plate 23 to pivot on the pin 24 in opposition to the biasing force of a return spring 39. The tip 29 is consequently forced out of the upper fold 35 and immediately thereafter returns to the upper surface of the hem until the sewing operation then in progress has been completed.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A hemming device for forming invisible stitches in tubular workpieces with areas of increased thickness in a sewing machine having a needle and presser foot aligned with a sewing axis associated with a needle plate mounted in the machine's worksurface, said hemming device comprising:

(a) a straight guide (11) pivotably mounted on the machine adjacent the sewing axis for maintaining alignment of a workpiece with the latter;

(b) a hemmer plate (23) pivotably attached to the upper surface of said straight guide including:

(i) a tip (29) disposed in spaced and overlying relation to the needle plate defining a passage therebetween for advance of the workpiece along the sewing axis;

(c) means defining a feeler (28) pivotably mounted on the machine in operative association with said passage for detecting those areas of a workpiece of increased thickness;

(d) actuator means operatively connected to said feeler (28) for displacing said straight guide (11) upon detection of areas of increased thickness of the workpiece; and (e) means forming a part of said straight guide (11) for maintaining the workpiece in alignment with the sewing axis after its displacement by said actuator means.

2. The structure according to claim 1 wherein said straight guide 11 includes a first vertical wall (12) for forming one side of said passage in combination with the needle plate and said hemmer plate (23).

3. The structure according to claim 2 wherein said maintaining means defines a second vertical wall (14) connected to and extending at an angle oblique to said first vertical wall (12).

4. The structure according to claim 1 wherein said hemmer plate includes means for selectively controlling the distance between said tip (29) and said feeler (28).

5. The structure according to claim 1 wherein said feeler (28) includes a depending tail piece (32) operatively associated with a detector element (33) in circuit with said actuator means.

6. The structure according to claim 1 wherein said actuator means defines an electromagnet (26).

* * * * *